United States Patent [19]

Query et al.

[11] Patent Number: 4,812,810

[45] Date of Patent: Mar. 14, 1989

[54] FIBER OPTIC DOOR SENSOR FOR A DOMESTIC APPLIANCE

[75] Inventors: Daniel S. Query, Antioch, Tenn.; Linda A. Zummer, Reims, France

[73] Assignee: Whirlpool Corporation, Benton Harbor, Mich.

[21] Appl. No.: 148,382

[22] Filed: Jan. 25, 1988

[51] Int. Cl.[4] ..... G08B 21/00

[52] U.S. Cl. ..... 340/545; 340/531; 340/600; 340/606

[58] Field of Search ..... 340/545, 686, 531, 600

[56] References Cited

U.S. PATENT DOCUMENTS

| | | | |
|---|---|---|---|
| 3,544,988 | 12/1970 | Astheimer | 340/686 |
| 3,909,819 | 9/1975 | Radford | 340/569 |
| 4,013,886 | 3/1977 | Schmid | 340/600 |
| 4,074,246 | 2/1978 | Conklin et al. | 340/545 |
| 4,241,336 | 12/1980 | Prada | 200/61.69 |
| 4,379,289 | 4/1983 | Peek | 340/531 |
| 4,507,654 | 3/1985 | Stolarczyk et al. | 340/545 |
| 4,516,022 | 5/1985 | Lindgren | 250/227 |
| 4,528,558 | 7/1985 | Steers et al. | 340/545 |
| 4,583,082 | 4/1986 | Naylor | 340/545 |
| 4,631,399 | 12/1986 | Ward | 250/227 |

*Primary Examiner*—Glen R. Swann, III

*Attorney, Agent, or Firm*—Mason, Kolehmainen, Rathburn & Wyss

[57] ABSTRACT

A fiber optic door ajar sensor for a domestic appliance such as a refrigerator/freezer having refrigerator compartment and freezer compartment doors includes a light transmitter and a light receiver. In one embodiment, a U-shaped loop of fiber optic cable is positioned relative to the transmitter and the receiver so that changes in the amount of light transmitted from the transmitter via the fiber optic cable to the receiver enables the receiver to determine whether one of the doors is open or slightly ajar. Another embodiment of the door ajar sensor includes a fiber optic cable having one end adjacent to one of the doors and a distal or transmitting end adjacent to a light receiver. When the door is opened or left ajar, ambient light is transmitted via the fiber optic cable to the receiver. The receiver responds to a preselected amount of light received via the fiber optic cable by providing a door open indication. In another embodiment of the door ajar sensor, a light transmitter and a light receiver are respectively positioned adjacent to the refrigerator and freezer doors. A first L-shaped fiber optic cable is disposed in the refrigerator door relative to the transmitter and a second L-shaped fiber optic cable is disposed in the freezer door relative to the receiver and the first fiber optic cable. If either of the doors is opened, less than a predetermined amount of light is received by the receiver from the transmitter so that a door open signal is provided.

21 Claims, 1 Drawing Sheet

FIBER OPTIC DOOR SENSOR FOR A DOMESTIC APPLIANCE

BACKGROUND OF THE INVENTION

1. Field of the Invention

The present invention relates to a door sensor for a domestic appliance and, more particularly, to a new and improved fiber optic sensor for a domestic appliance, the sensor determining whether a door or doors of the appliance are open or slightly ajar.

2. Description of the Prior Art

In a domestic appliance such as a refrigerator/-freezer, a refrigerator door is hingedly mounted along one edge of the refrigerator/freezer in order to permit access into and to seal a refrigerator compartment or section. In a similar manner, a freezer door is hingedly mounted along one of the side edges of the refrigerator/freezer in order to permit access into and to seal a freezer compartment or section. If one of these doors is left open or slightly ajar, the compartment is no longer properly sealed requiring an excessive amount of energy to be used to maintain the compartment at the proper temperature level to prevent food stored therein from spoiling.

Various types of sensors have been used in such appliances to determine if one of the doors has been left open or slightly ajar and to activate a visual and/or audible warning signal if the door is so open. One such sensor includes a plunger that protrudes from the front frame of the refrigerator cabinet. When the door is properly closed, the plunger is depressed and maintains contacts within a microswitch in a non-actuated state. In the event the door is opened, the plunger protrudes from the front frame of the refrigerator actuating the microswitch which in turn causes the interior lights of the refrigerator to turn on and/or provides a door open signal. Plunger type sensor arrangements have moving parts which may be adversely affected by the accumulation of dirt or debris. Moreover, if the microswitch used in such plunger type arrangements is operated at a low voltage or current, the microswitch becomes relatively expensive for use in an appliance.

Magnetic sensing devices have also been used in a refrigerator to determine whether a door is open. In such a device, a magnet is mounted on the frame of the refrigerator and a magnetic sensor is positioned on the interior face of the refrigerator door. When the door is opened, the magnet is moved away from the magnetic sensor and a switch associated with the magnetic sensor is activated to provide a door open signal. While these magnetic sensing devices tend to be less expensive and less sensitive to dirt problems than the plunger type arrangements, they typically do not accurately sense when a door is left only slightly open or ajar.

In order to overcome the problems associated with the plunger and magnetic sensing devices, magnetic field responsive switches, for example Hall effect sensors, have been used. In U.S. Pat. No. 4,241,337, such a magnetic field responsive switch is disclosed for determining when a refrigerator door is open or closed. A similar sensing device is disclosed in U.S. Pat. No. 4,074,246 wherein audio frequency transducers are used to detect when a window or door has been opened. U.S. Pat. No. 4,074,246 alternatively discloses the use of an infrared transmitter and receiver interconnected by a mirror to provide an alarm when a door or window is left open.

Various other arrangements have been used to detect the movement or displacement of different types of objects. For example, in U.S. Pat. No. 3,544,988, the movement of an object is sensed by having an illuminator portion of an infrared sensor project a beam of infrared radiation to a cylindrical mirror mounted on an object whose displacement is to be detected. The infrared radiation is reflected by the mirror to a receiver located in a common housing with the illuminator. When the object is moved, an alarm signal is activated. A similar position detector is disclosed in U.S. Pat. No. 4,507,654 wherein an infrared tranmitter and an infrared detector are used for determining whether a door or window is ajar. The infrared light produced by the transmitter is pulsed and is reflected onto a receiver by a reflector affixed to the door or window. When the pulsed light being received is not coincident with a pulse signal from a pulse generator, an alarm is activated to indicate that the door or window is open. U.S. Pat. No. 4,583,082 also relates to an apparatus for monitoring whether a door of a coin operated machine is open or closed, the apparatus including a light emitting diode and an aligned photocell sensor wherein a microprocessor monitors the light emitting diode and the photocell sensor to provide an alarm signal when the two are not in optical communication.

Another door monitoring apparatus is disclosed in U.S. Pat. No. 3,909,819. In that patent the door being monitored is the door of a mailbox. A photocell is mounted in the mailbox such that if the door of the mailbox is opened, the external ambient light entering the mailbox is detected by the photocell. Upon the detection of external light an indication of the opening of the mailbox door is provided. An intrusion detector is disclosed in U.S. Pat. No. 4,013,886, in which a light transmitter and receiver are mounted on a common body. If an object intrudes into the path of the light beam being projected from the transmitter to the receiver, a warning signal is provided.

An example of how fiber optics may be used to actuate a switch when moved in alignment with a sensor is shown in U.S. Pat. No. 4,631,399. More specifically, the patent shows a switch having an array of phototransistors each representing a selectable switch position wherein a selectively rotatable fiber optic is used to transmit light from a light emitting diode to one of the phototransistors to cause it to conduct current to a keyboard encoder.

SUMMARY OF THE INVENTION

One object of the present invention is to provide a new and improved door ajar sensor for an appliance such as a refrigerator/freezer which sensor utilizes a fiber optic cable.

Another object of the present invention is to provide a new and improved fiber optic door ajar sensor for a refrigerator/freezer in which light from a transmitter is transmitted to a receiver by a fiber optic cable when the door or doors of the refrigerator/freezer are closed.

Yet another object of the present invention is to provide a new and improved fiber optic door ajar sensor for a refrigerator/freezer in which a fiber optic cable is positioned in the refrigerator and/or freezer door or in the frame of the refrigerator/freezer such that the amount of light transmitted via the fiber optic cable to a receiver is indicative of whether the refrigerator door and/or the freezer door are properly closed.

In accordance with these and many other objects of the present invention, one embodiment of the invention includes a fiber optic door sensor for a domestic appliance such as a refrigerator/freezer having a refrigerator compartment and a separate freezer compartment each with a door for sealing the compartment. A light transmitter and light receiver are positioned side by side on the frame of the refrigerator adjacent to the refrigerator door. A U-shaped fiber optic cable is positioned in the refrigerator compartment door so that as long as the refrigerator compartment door is completely closed, a receiving end of the fiber optic cable is precisely aligned with the transmitter and a transmitting end of the fiber optic cable is aligned with the receiver. If the door is open or left slightly ajar, the receiving end of the fiber optic cable is no longer precisely aligned with the transmitter and the transmitting end of the cable is no longer precisely aligned with the receiver so that the receiver receives less light than if the door were closed. The receiver determines whether a warning or door open signal should be produced based on the amount of light received. A similar sensor with a fiber optic cable disposed in the freezer door may be used to determine whether the freezer door is completely closed.

In another embodiment of the present invention, a fiber optic cable is positioned in the frame of the refrigerator/freezer adjacent to the refrigerator compartment door. The fiber optic cable is connected at a distal or transmitting end to a light receiver located in the interior of the refrigerator. As long as the door is fully closed, no ambient light impinges on the receiving end of the fiber optic cable or is transmitted to the receiver so that the receiver has an indication that the refrigerator door is completely closed. When the door is opened or left ajar, ambient light from the room where the refrigertor/freezer is located, for example, impinges on the receiving end of the fiber optic cable and is transmitted via the fiber optic cable to the receiver. If the receiver receives a preselected amount of light via the fiber optic cable, a door open warning indication can be provided. Another similar sensor may be positioned with respect to the freezer door to separately determine whether the freezer door is completely closed.

In another embodiment of the present invention a light transmitter is positioned in the frame of the refrigerator adjacent to the refrigerator door. An L-shaped fiber optic cable is mounted in the refrigerator compartment door so that a receiving end of the cable is in direct alignment with the transmitter when the refrigerator compartment door is completely closed. A second L-shaped fiber optic cable is disposed in the freezer compartment door such that when the refrigerator and freezer compartment doors are completely closed, a receiving end of the freezer door cable is in direct alignment with a transmitting end of the refrigerator door cable. A light receiver is positioned in the frame of the refrigerator adjacent to the freezer door and in alignment with a transmitting end of the freezer door cable when the freezer door is closed. When both the refrigerator and freezer compartment doors are completely closed, light from the transmitter is transmitted through the refrigerator door fiber optic cable to the freezer door fiber optic cable and through that cable to the receiver enabling the receiver to determine that both doors are properly closed. However, in the event that either of the doors is left open or slightly ajar, the light from the transmitter is not received in a sufficient amount by the receiver via the L-shaped fiber optic cables because the cables are out of alignment with each other and either or both of the transmitter and receiver. When an insufficient amount of light is detected by the receiver, a door open signal can be provided to indicate that at least one of the doors is not completely closed.

DESCRIPTION OF THE DRAWING

Many other objects of the present invention will become apparent from considering the following detailed description in conjunction with the drawing in which.

DESCRIPTION OF THE PREFERRED EMBODIMENT

Figure 1:
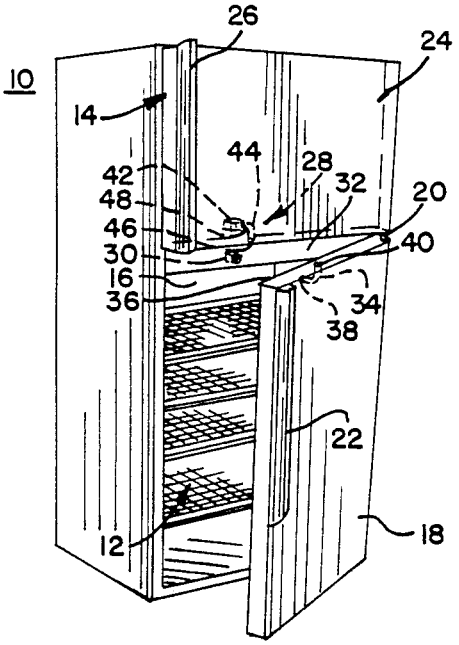
FIG. 1 is a perspective view of a refrigerator/freezer appliance having a fiber optic door ajar sensor embodying the present invention for detecting the opening of either the refrigerator door or the freezer door.

A top mount refrigerator/freezer 10, as shown in FIG. 1, has a lower refrigerator section 12 and a top freezer section 14. A front opening 16 of the refrigerator section 12 provides access into the refrigerator section 12 and is selectively sealed by a refrigerator door 18 hingedly mounted along an edge 20 of the refrigerator/-freezer 10. The refrigerator door 18 has a handle 22 so that it ca be pivoted about the edge 20 to an open position as illustrated. In a similar manner, a freezer door 24 is hingedly mounted along the edge 20 of the refrigerator/freezer 10 and provides access into and seals the freezer section 14. The freezer door 24 also has a handle 26 so that it can be pivoted to an open position to provide access into the freezer compartment 14. The refrigerator/freezer 10 has a fiber optic door ajar sensor 28 constructed in accordance with the principles of the present invention. The sensor 28 is used to detect whether the refrigerator compartment door 18 or the freezer compartment door 24 is open or slightly ajar. When the sensor 28 detects that one of the doors 18 or 24 is open or slightly ajar, a warning signal may be provided to indicate that one or both of the doors 18 and 24 are not properly closed.

Figure 2:
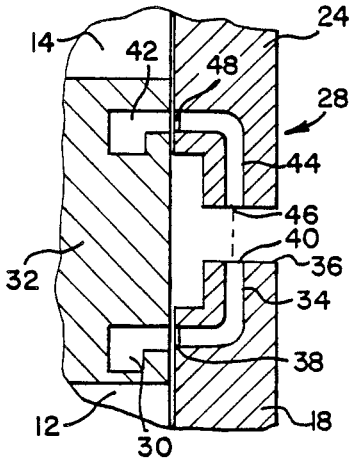
FIG. 2 is an enlarged, partial cross sectional view showing the fiber optic door ajar sensor disclosed in FIG. 1.

The door ajar sensor 28 includes a standard fiber optic transmitter 30 that emits light. The transmitter 30 is mounted adjacent to the refrigerator door 18 in the refrigerator frame or mullion 32 between the refrigerator section 12 and the freezer section 14. A suitable type of transmitter is available from Molex Incorporated, part No. 40398-E*-2S. A generally L-shaped fiber optic cable 34 (FIGS. 1 and 2) having a receiving end 38 and a transmitting end 40 is disposed near a top edge 36 of the refrigerator door 18 such that the transmitting end 40 is flush with the top edge 36 of the door 18. More specifically, the fiber optic cable 34 is positioned in the door 18 such that when the door 18 is closed, the receiving end 38 is aligned to receive light from the transmitter 30. The fiber optic cable 34 may be a standard single channel fiber optic cable. For example, the fiber optic cable 34 can be a cable, part No. 41153-B Simplex, available from Molex Incorporated. When the refrigerator door 18 is completely closed as illustrated in FIG. 2, the receiving end 38 of the fiber optic cable 34 is in direct alignment with the transmitter 30 such that light being emitted by the transmitter 30 impinges on the receiving end 38 and travels along the fiber optic cable 34 to the transmitting end 40.

The door ajar sensor 28 also includes a receiver 42 disposed in the refrigerator frame 32 adjacent to the freezer door 24. A suitable type of receiver is available from Molex Incorporated, part No. 40398-A1-2F. A second L-shaped fiber optic cable 44 is embedded in the freezer door 24 (FIGS. 1 and 2). As with respect to the cable 34, the fiber optic cable 44 may be a standard single channel fiber optic cable such as cable, part No. 41153-B Simplex, available from Molex Incorporated. The fiber optic cable 44 extends between a receiving end 46 and a transmitting end 48 and is positioned in the freezer door 24 such that as long as the freezer door 24 is completely closed, the transmitting end 48 of the fiber optic cable 44 is in direct alignment with the receiver 42 located in the frame section 32. In addition, when both the doors 18 and 24 are completely closed as illustrated in FIG. 2 of the drawing, the transmitting end 40 of the fiber optic cable 34 is in direct alignment with the receiving end 46 of the fiber optic cable 44. As a result, when both doors 18 and 24 are closed, the light emitted by the transmitter 30 travels through the fiber optic cable 34 from the receiving end 38 to the transmitting end 40; is projected to the receiving end 46 of the fiber optic cable 44; and travels through the fiber optic cable 44 from the receiving end 46 to the transmitting end 48 where it can be detected by the receiver 42.

Standard available circuitry (not shown) coupled to or contained within the receiver 42 determines whether the amount of light being received by the receiver 42 from the transmitter 30 via the fiber optic cables 34 and 44 is sufficient to indicate that both the refrigerator compartment door 18 and the freezer compartment door 24 are completely closed. In the event that either or both of the doors 18 and 24 are left open to any extent, a lesser amount of light from the transmitter 30 is received by the receiver 42 via the L-shaped fiber optic cables 34 and 44 because the cables 34 and 44 are not in precise alignment with each other when either or both of the doors 18 and 24 are not completely closed. In response to the receiver 42 detecting a preselected lesser amount of light from the transmitter 30, the detecting circuitry provides a door open signal to indicate that one or both of the doors 18 and 24 are not completely closed.

Even though only one transmitter 30 and one receiver 42 are used in the door ajar sensor 28, the sensor 28 can nevertheless detect whether either or both of the doors 18 and 24 are not completely closed. Moreover, while the transmitter 30 is shown positioned adjacent to the refrigerator compartment door 18 and the receiver 42 is shown positioned adjacent to the freezer compartment door 24, the locations of the transmitter 30 and the receiver 42 may be switched so that the receiver 42 is positioned adjacent to the refrigerator compartment door 18 and the transmitter 30 is positioned adjacent to the freezer compartment door 24.

Figure 3:
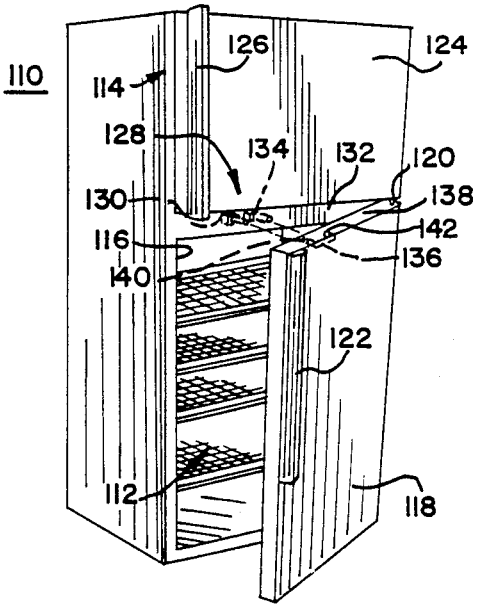
FIG. 3 is perspective view similar to FIG. 1 disclosing an alternate embodiment of a fiber optic door ajar sensor embodying the present invention in which the sensor detects whether a door of the refrigerator/-freezer is open.

Another embodiment of the door ajar sensor of the present invention is shown in FIG. 3 for a top mount refrigerator/freezer 110. The refrigerator/freezer 110 is essentially the same as the refrigerator/freezer 10 shown in FIG. 1 in that it has a lower refrigerator section 112 and a top freezer section 114. A front opening 116 provides access into the refrigerator section 112 and is selectively sealed by a refrigerator door 118 hingedly mounted along an edge 120 of the refrigerator/freezer 110. The refrigerator door 118 has a handle 122 so that it can be pivoted about the edge 120 to an open position as illustrated in FIG. 3. In a similar manner, a freezer door 124 is hingedly mounted along the edge 120 of the refrigerator/freezer 110 and provides access into and seals the freezer section 114. The freezer door 124 also has a handle 126 so that it can be pivoted to an open position to provide access into the freezer compartment 114. Another embodiment of the fiber optic door ajar sensor 128 constructed in accordance with the principles of the present invention is used by the refrigerator/freezer 110 to detect whether the refrigerator compartment door 118 is not completely closed. When the sensor 128 detects that the door 118 is open or slightly ajar, a warning signal may be provided to indicate that the door 118 is not properly closed.

The door ajar sensor 128 includes a standard fiber optic transmitter 130 that emits light. The transmitter 130 is mounted adjacent to the refrigerator door 118 in the refrigerator frame or mullion 132 located between the refrigerator section 112 and the freezer section 114. A receiver 134 is disposed in the frame section 132 along side of the transmitter 130. A U-shaped loop of fiber optic cable 136 is positioned adjacent a top edge 138 of the refrigerator compartment door 118 in close proximity to the transmitter 130 and the receiver 134. More specifically, the fiber optic cable 136 is disposed in the door 118 such that as long as the refrigerator compartment door 118 is completely closed, a receiving end 140 of the fiber optic cable 136 is in direct alignment with the transmitter 130 and a transmitting end 142 of the U-shaped fiber optic cable 136 is in direct alignment with the receiver 134. As a result, when the door 118 is closed, light emitted by the transmitter 130 impinges on the receiving end 140 of the fiber optic cable 136 and travels along the fiber optic cable 136 to the transmitting end 142 so as to be projected onto the receiver 134. If the door 118 is open or left slightly ajar, the receiving end 140 of the fiber optic cable 136 is no longer in precise alignment with the transmitter 130 and the transmitting end 142 of the cable 136 is no longer in precise alignment with the receiver 134. Consequently, a lesser amount of the light emitted by the transmitter 130 is transmitted via the fiber optic cable 136 to the receiver 134. Accordingly, when the receiver 134 detects that a lesser amount of light is received from the transmitter 130 via the cable 136, a warning or door open signal is provided.

If it is desired to monitor the position of the freezer compartment door 124, another sensor similar to the sensor 128 can be provided. More specifically, a second transmitter and a second receiver could be mounted adjacent to the freezer door 124 in the mullion 132 above the transmitter 130 and the receiver 134. A second U-shaped fiber optic cable could then be mounted in the freezer door 124 and aligned with the the second transmitter and receiver.

The transmitter 130 and the receiver 134 of the door ajar sensor 128 are disclosed in FIG. 3 as being mounted in the frame section 132, but it should be understood that they may be mounted in other frame members of the refrigerator/freezer 110 with the U-shaped fiber optic cable 136 positioned adjacent to and in alignment with the transmitter 130 and the receiver 134 to determine whether the door 118 and/or the door 124 are open or slightly ajar.

Figure 4:
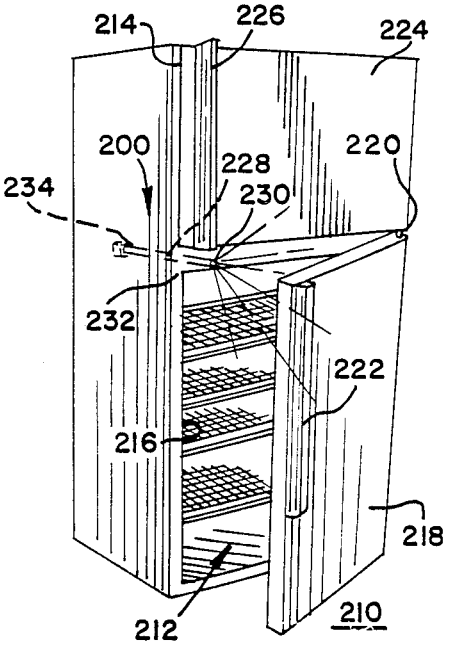
FIG. 4 is perspective view similar to FIG. 1 disclosing yet another embodiment of a fiber optic door ajar sensor embodying the present invention in which the sensor utilizes ambient light to detect whether a door of the refrigerator/freezer is open.

The fiber optic door ajar sensors 28 and 128 used with the refrigerator/freezers 10 and 110, respectively, each requires a transmitter (30, 130), a receiver (42, 134) and a fiber optic cable (136) or fiber optic cables (34, 44) to transmit the light emitted from the transmitter to the receiver. In FIG. 4, another embodiment of the fiber optic door ajar sensor 200 constructed in accordance with the principles of the present invention is shown for use with a refrigerator/freezer 210. The refrigerator/-freezer 210 has a lower refrigerator section 212 and a top freezer section 214. A front opening 216 provides access into the refrigerator section 212 and is selectively sealed by a refrigerator door 218 hingedly mounted along an edge 220 of the refrigerator/freezer 210. The refrigerator door 218 has a handle 222 so that it can be pivoted about the edge 220 to an open position as illustrated in FIG. 4. In a similar manner, a freezer door 224 is hingedly mounted along the edge 220 of the refrigerator/freezer 210 and provides access into and seals the freezer section 214. The freezer door 224 also has a handle 226 so that it can be pivoted to n open position to provide access into the freezer compartment 214. The fiber optic door ajar sensor 200 is used to detect whether the refrigerator compartment door 218 is not completely closed. When the sensor 200 detects that the door 218 is open or slightly ajar, a warning signal may be provided to indicate that the door 218 is not properly closed.

The door ajar sensor 200 includes a single fiber optic cable 228 having a receiving end 230 positioned adjacent to the refrigerator door 218 in a frame section or mullion 232 between the refrigerator compartment 212 and the freezer compartment 214. The cable extends from the frame section 232 to a receiver 234 disposed at any convenient location in the interior of the refrigerator/freezer 210. As long as the refrigerator compartment door 218 is completely closed, no ambient light or light from the interior of the refrigerator compartment 212 impinges on the receiving end 230 of the fiber optic cable 228. Consequently, the lack of light being received by the receiver 234 is an indication that the door 218 is properly closed. When the door 218 is opened or left ajar, ambient light from the room where the refrigertor/freezer 210 is located impinges on the receiving end 230 of the fiber optic cable 228 and is transmitted via the fiber optic cable 228 to the receiver 234. When the receiver 234 receives a preselected amount of light via the cable 228, a door open warning is provided.

While the sensor 200 is shown as being used to detect if the refrigerator door 218 is open, a similar sensor may be used to determine if the freezer compartment door 224 is open. In addition, it should be understood that the sensor 200 including the receiver 234 and the cable 228 can be disposed in the door 218 or door 224 instead of the frame section 232.

Advantageously, the sensors 28, 128 and 200 have no moving parts so that they are less susceptible to being adversely affected by dirt. Moreover, since the sensors 28, 128 and 200 respond to the amount of light received by the receivers 42, 134 and 234, respectively, the sensors 28, 128 and 200 may be adjusted so that a door open signal is provided only if the doors are open a predetermined amount or for a preselected amount of time. The door open signal can be a visual signal displayed in an information panel located on the refrigerator/freezers 10, 110 or 210. In addition, it should be understood that the sensors 28, 128 and 200 are not limited to use in a top mount refrigerator/freezers such as the disclosed refrigerator/freezers 10, 110 and 210. The sensors 28, 128 and 200 may be used in any domestic appliance having a door or doors.

Obviously, many modifications and variations of the present invention are possible in light of the above teachings. Thus, it is to be understood that, within the scope of the appended claims, the invention may be practiced otherwise than as specifically described hereinabove.

What is claimed and is desired to be secured by Letters Patent is:

1. A sensor for a domestic appliance used to determine the relative position of first and second structures of said appliance movable with respect to each other, said sensor comprising:

fiber optic means disposed in said appliance relative to said second structure for transmitting light impinging on a first end of said fiber optics means to a second end of said fiber optic means, said first end being disposed adjacent to said first structure; and receiver means disposed in said appliance adjacent said second end of said fiber optic means for sensing light, said receiver means being responsive to light transmitted from said second end of said fiber optic means to detect a given position of said first structure relative to said second structure.

2. The sensor as set forth in claim 1 wherein said fiber optic means is a fiber optic cable having said first end disposed so that said fiber optic cable receives ambient light when said first structure has moved away from said second structure.

3. The sensor as set forth in claim 1 including a light transmitter disposed in said first structure and wherein said fiber optic means is a U-shaped fiber optic cable disposed in said second structure and having said first end disposed relative to said transmitter such that said transmitter projects light onto said first end whenever said first structure is in a given position relative to said second structure.

4. The sensor as set forth in claim 1 including a third structure movable relative to said first and second structures; and a light transmitter disposed in said first structure, wherein said receiver means is disposed in said first structure and said fiber optic means includes a first fiber optic cable disposed in said second structure and a second fiber optic cable disposed in said third structure such that said receiver means senses light transmitted from said transmitter through said first and second fiber optic cables when said first and third structures are in a given position relative to each other and said second structure.

5. The sensor as set forth in claim 4 wherein said second and third structures are doors of said appliance and said first structure is a frame portion of said appliance, said second and third structures each being pivotal with respect to said frame portion.

6. The sensor as set forth in claim 1 wherein said appliance is a refrigerator/freezer.

7. The sensor as set forth in claim 1 wherein said first structure is a door of said appliance and said second structure is a frame portion of said appliance 8. A door sensor for a domestic appliance having a frame and at least one door movable with respect to said frame between open and closed positions, said sensor comprising:

a transmitter means disposed in said appliance for emitting light;

a receiver means disposed in said appliance for receiving light emitted by said transmitter; and fiber optic means for transmitting light from said transmitter means to said receiver means, said fiber optic means being disposed in said appliance relative to said transmitter means and said receiver means such that said fiber optic means transmits at least a predetermined amount of light from said transmitter means to said receiver means when said door is in said closed position and said fiber optic means transmit less than said predetermined amount of light when said door is in said open position.

9. The sensor as set forth in claim 8 wherein said fiber optic means is a U-shaped fiber optic cable having first and second ends, said first end being positioned relative to said transmitter means such that said transmitter means projects light onto said first end when said door is in said closed position and said second end being positioned relative to said receiver means such that when said door is in said closed position said receiver receives from said second end the light projected onto said first end.

10. The sensor as set forth in claim 9 wherein said fiber optic cable is disposed in said door and said transmitter means and said receiver means are disposed adjacent to each other in said frame.

11. The sensor as set forth in claim 8 wherein said receiver means provides a warning signal when said receiver means does not receive said predetermined amount of light from said transmitter means through said fiber optics means.

12. A door sensor for a domestic appliance having a first door and a second door, each of said first and second doors having closed and open positions, said sensor comprising:

a transmitter means disposed in said appliance adjacent to said first door for emitting light;

a first fiber optic means disposed in said first door for transmitting light impinging on a first end of said first fiber optic means from said transmitter means to a second end of said first fiber optic means when said first door is in said closed position;

a second fiber optic means disposed in said second door for transmitting light impinging on a first end of said second fiber optic means to a second end of said second fiber optic means, said first end receiving light emitted from said second end of said first fiber optic means when both of said first and second doors are in said closed position; and a receiver means disposed in said appliance adjacent said second door for receiving light, said receiver means receiving light emitted from said second end of said second fiber optic means when said second door is in said closed position.

13. The sensor as set forth in claim 12 wherein said first fiber optic means is a first L-shaped fiber optic cable and wherein said second fiber optic means is a second L-shaped fiber optic cable.

14. The sensor as set forth in claim 12 wherein said receiver means provides a warning signal when said receiver means does not receive from said second fiber optic means a predetermined amount of light emitted from said transmitter means.

15. The sensor as set forth in claim 12 wherein said appliance is a refrigerator/freezer, said first door is a refrigerator compartment door pivotal with respect to a frame of the refrigerator/freezer and said second door is a freezer compartment door pivotal with respect to said frame.

16. A door sensor for a domestic appliance having at least one door movable to at least one position, said door sensor comprising:

transmitter means for emitting light, said transmitter being disposed in said appliance;

receiver means for receiving light emitted by said transmitter means, said receiver means being disposed in said appliance adjacent to said transmitter; and a fiber optic cable having a receiving end and a transmitting end, said fiber optic cable being disposed relative to said transmitter means and said receiver means such that said receiving end is in direct alignment with said transmitter and said transmitting end is in direct alignment with said receiver when said door is in said one position.

17. The sensor as set forth in claim 16 wherein said fiber optic cable is a generally U-shaped cable disposed in said door.

18. The sensor as set forth in claim 16 wherein said appliance is a refrigerator/freezer and said door is a refrigerator door being closed when in said one position.

19. A door sensor for a domestic appliance having a first door and a second door, each of said first and second doors having first and second positions, said door sensor comprising:

transmitter means for emitting light, said transmitter means being disposed in said appliance;

receiver means for receiving light emitted by said transmitter means, said receiver means being disposed in said appliance adjacent said transmitter means;

a first fiber optic cable having a first receiving end and a first transmitting end, said first fiber optic cable being disposed in said first door relative to said transmitter means such that said first receiving end is in direct alignment with said transmitter means when said door is in said first position; and a second fiber optic cable having a second receiving end and a second transmitting end, said second fiber optic cable being disposed relative to said first fiber optic cable and said receiver means such that said second receiving end is in direct alignment with said first transmitting end and said second transmitting end is in direct alignment with said receiver means when both said first and second doors are in said first position.

20. The sensor as set forth in claim 19 wherein said first fiber optic cable is a generally L-shaped cable and said second fiber optic cable is a generally L-shaped cable.

21. The sensor as set forth in claim 19 wherein said appliance is a refrigerator/freezer, said first door is a refrigerator compartment door and is closed when in said first position and said second door is a freezer compartment door and is closed when in said first position.

* * * * *

UNITED STATES PATENT AND TRADEMARK OFFICE

CERTIFICATE OF CORRECTION

PATENT NO. : 4,812,810

DATED : March 14, 1989

INVENTOR(S) : Query et al

It is certified that error appears in the above-identified patent and that said Letters Patent is hereby corrected as shown below:

Column 2, line 14, "tranmitter" to --transmitter--.
Column 4, line 41, "ca" to --can--.
Column 7, line 28, "n" to --an--.

Signed and Sealed this

Thirty-first Day of October, 1989

*Attest:*

DONALD J. QUIGG

*Attesting Officer*

*Commissioner of Patents and Trademarks*